US010851680B2

(12) United States Patent
Okamoto

(10) Patent No.: US 10,851,680 B2
(45) Date of Patent: Dec. 1, 2020

(54) INTERNAL COMBUSTION ENGINE AND VEHICLE

(71) Applicant: YAMAHA HATSUDOKI KABUSHIKI KAISHA, Iwata (JP)

(72) Inventor: Yasuo Okamoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/627,138

(22) PCT Filed: Apr. 27, 2018

(86) PCT No.: PCT/JP2018/017283

§ 371 (c)(1),
(2) Date: Dec. 27, 2019

(87) PCT Pub. No.: WO2019/003629

PCT Pub. Date: Jan. 3, 2019

(65) Prior Publication Data

US 2020/0182099 A1 Jun. 11, 2020

(30) Foreign Application Priority Data

Jun. 30, 2017 (JP) ..... 2017-128790

(51) Int. Cl.
*F01L 1/18* (2006.01)

(52) U.S. Cl.
CPC ..... *F01L 1/185* (2013.01); *F01L 2001/187* (2013.01)

(58) Field of Classification Search
CPC ..... F01L 1/185; F01L 2001/186; F01L 2001/187; F01L 1/46
USPC ..... 123/90.41, 90.44
See application file for complete search history.

(56) References Cited

U.S. PATENT DOCUMENTS 3,217,699 A * 11/1965 Dolza ..... F01L 1/185 123/90.25
4,768,467 A * 9/1988 Yamada ..... F01L 13/0005 123/90.16
5,806,477 A * 9/1998 Regueiro ..... F01L 1/185 123/90.22

(Continued)

FOREIGN PATENT DOCUMENTS

DE 10 2007 025 182 A1 12/2008
DE 10 2015 203 049 A1 8/2016

(Continued)

OTHER PUBLICATIONS

Official Communication issued in International Patent Application No. PCT/JP2018/017283, dated Jun. 26, 2018.

*Primary Examiner* — Jorge L Leon, Jr.
(74) *Attorney, Agent, or Firm* — Keating and Bennett, LLP

(57) ABSTRACT

An internal combustion engine allows easy installment of a support that pivotally supports a rocker arm while preventing fretting wear due to rising of the support. The internal combustion engine includes the support, at least a portion of which is located in a hole of a cylinder head, a rocker arm that is pivotally supported on the support, and a ball plunger that secures the support inside the hole. The ball plunger includes a spring seat that contacts with the support, a ball that contacts with the cylinder head, and a spring interposed between the spring seat and the ball.

9 Claims, 14 Drawing Sheets

(56) References Cited

U.S. PATENT DOCUMENTS

| | | | | |
|---|---|---|---|---|
| 2013/0306016 | A1 | 11/2013 | Kato | |
| 2013/0340694 | A1 | 12/2013 | Nakamura | |
| 2014/0202406 | A1* | 7/2014 | Nakamura | F01L 1/46 123/90.15 |
| 2016/0040563 | A1 | 2/2016 | Shewell | |

FOREIGN PATENT DOCUMENTS

| | | | |
|---|---|---|---|
| GB | 963995 | A | 7/1964 |
| JP | 2009-185753 | A | 8/2009 |
| JP | 2013-241887 | A | 12/2013 |
| JP | 2015-206335 | A | 11/2015 |
| WO | 2017/038748 | A1 | 3/2017 |

* cited by examiner

INTERNAL COMBUSTION ENGINE AND VEHICLE

BACKGROUND OF THE INVENTION

1. Field of the Invention

The present invention relates to an internal combustion engine and a vehicle.

2. Description of the Related Art

There are conventional internal combustion engines that have a valve mechanism including: a circular columnar-shaped support member that is inserted into a hole formed in a cylinder head; a rocker arm that is pivotally supported on the support member; and a cam that is provided on a cam shaft and is in contact with the rocker arm. Japanese Laid-Open Patent Publication No. 2009-185753 discloses a valve mechanism that includes a lash adjuster as the support member.

In the valve mechanism, the rocker arm is held down by the cam. Therefore, the support member is held down by the cam with the rocker arm therebetween. However, the support member is only inserted into the hole of the cylinder head and is not particularly secured to the cylinder head. While the internal combustion engine is running, a load in the axial direction of the support member is repeatedly generated on the support member. Therefore, the support member may possibly rise from the hole, leading to problems such as fretting wear. On the other hand, if the support member is secured to the cylinder head using screws in order to prevent the rise, it will detract from the ease of installment of the support member.

SUMMARY OF THE INVENTION

Preferred embodiments of the present invention provide internal combustion engines that each allow a support to be installed easily while preventing fretting wear, or the like, due to rising of the support, and vehicles including the same.

An internal combustion engine according to a preferred embodiment of the present invention includes a cylinder including a hole; a port in the cylinder; a valve in the cylinder that opens/closes the port; a cam shaft rotatably supported on the cylinder; a cam provided on the cam shaft; a columnar support at least a portion of which is inserted into the hole of the cylinder; a rocker arm that includes a supported portion pivotally supported on the support, a pressed portion pressed by the cam, and an abutting portion to abut on the valve; and a retainer that secures the support inside the hole. The retainer includes a first contact portion that contacts the support, a second contact portion that contacts the cylinder, and an elastic portion interposed between the first contact portion and the second contact portion.

With the internal combustion engine described above, when the support is pushed into the hole of the cylinder, the support is inserted into the hole. The support is inserted into the hole and is then secured inside the hole by the elastic force of the elastic portion of the retainer. With the internal combustion engine described above, there is no need for an operation of securing the support to the cylinder by using screws, for example. This makes easy the installment of the support. Since the support is secured by the elastic force of the elastic portion of the retainer, it is possible to prevent the support from rising from the hole. Therefore, with the internal combustion engine described above, it is possible to prevent fretting wear, or the like, due to rising of the support while maintaining the ease of installment of the support.

According to a preferred embodiment of the present invention, the retainer includes a plunger that includes a spring located inside the support, and a presser at least a portion of which is located outside the support and that is connected to the spring.

According to the preferred embodiment described above, the retainer is simple and compact. By appropriately setting the spring constant, etc., of the spring, the ease of operation of inserting the support into the hole and the prevention of rising of the support are easily achieved in a well-balanced manner.

According to a preferred embodiment of the present invention, the retainer includes a snap ring that is fitted to the support.

According to the preferred embodiment described above, the retainer is simple and compact.

According to a preferred embodiment of the present invention, the retainer includes a ring-shaped coil spring that is wound around the support.

According to the preferred embodiment described above, the retainer is simple and compact.

According to a preferred embodiment of the present invention, a groove that engages with the retainer is provided on an inner surface of the hole of the cylinder.

According to the preferred embodiment described above, when the support is inserted into the hole of the cylinder, the retainer engages with the groove, thus securing the support inside the hole. As the retainer engages with the groove, the support is even less likely to rise from the hole. Therefore, the ease of installment of the support and the prevention of fretting wear, or the like, due to rising of the support are both realized at a high level.

According to a preferred embodiment of the present invention, in a cross section that passes through the groove and includes a center line of the hole, the groove includes a sloped surface that is inclined relative to the center line of the hole and extends toward the center line of the hole as it extends toward the rocker arm along a direction of the center line of the hole.

According to the preferred embodiment described above, the support is even less likely to rise from the hole. Therefore, it is possible to even better prevent fretting wear, or the like, due to rising of the support.

According to a preferred embodiment of the present invention, the groove is cone-shaped or circular columnar-shaped and has an axis that is inclined relative to the center line of the hole.

According to the preferred embodiment described above, the groove is able to be machined by inserting a tool such as a drill or an endmill into the hole of the cylinder from outside in a direction that is slanted relative to the center line of the hole. Therefore, the groove is formed in a simple and inexpensive manner.

According to a preferred embodiment of the present invention, the hole and the support each have a circular columnar shape. The groove is a circumferential groove provided on an inner circumferential surface of the hole.

Where the groove is provided only at one point in the circumferential direction of the hole, if the position at which the groove is machined is shifted in the circumferential direction, the position at which the support is attached in the circumferential direction may possibly be shifted. However, according to the preferred embodiment described above, since the groove has a circumferential pattern, the position at which the support is attached in the circumferential direction is prevented from being shifted. Therefore, even if the machining precision of the groove is relatively low, it is possible to properly machine the groove. Thus, the groove is able to be formed in a simple and inexpensive manner.

According to a preferred embodiment of the present invention, the retainer includes a plunger that includes a spring located inside the cylinder, and a presser at least a portion of which is located inside the hole of the cylinder and that is connected to the spring.

According to the preferred embodiment described above, it is possible to increase the degree of freedom in the position of installing of the retainer. By appropriately setting the spring constant, etc., of the spring, the ease of operation of inserting the support into the hole and the prevention of rising of the support are achieved in a well-balanced manner.

According to a preferred embodiment of the present invention, the retainer includes a snap ring that is fitted to an inner surface of the hole of the cylinder.

According to the preferred embodiment described above, the retainer is simple and compact.

According to a preferred embodiment of the present invention, the retainer includes a ring-shaped coil spring that is fitted to an inner surface of the hole of the cylinder.

According to the preferred embodiment described above, the retainer is simple and compact.

According to a preferred embodiment of the present invention, the retainer includes a leaf spring that is secured to an edge of the hole of the cylinder.

According to the preferred embodiment described above, the retainer is simple.

According to a preferred embodiment of the present invention, the rocker arm includes a first arm that includes the supported portion and the abutting portion, and a second arm that includes the pressed portion and is pivotally supported on the first arm. The internal combustion engine includes a connector that removably connects the first arm and the second arm. The support is unable to expand/contract in an axial direction of the support.

Where the rocker arm includes the second arm that is pivotally supported on the first arm, and the support is able to contract/expand in the axial direction, such as a lash adjuster, the relative position between the first arm and the second arm may possibly be shifted following the expansion/contraction of the support when the connection between the first arm and the second arm is disconnected. As a result, the second arm may be shifted from the intended position relative to the first arm, and the connector may fail to properly connect the first arm and the second arm. However, according to the preferred embodiment described above, since the support is unable to expand/contract in the axial direction, it is possible to securely connect the first arm and the second arm.

A vehicle according to a preferred embodiment of the present invention includes the internal combustion engine described above.

Thus, it is possible to obtain a vehicle that realizes the advantageous effects described above.

According to preferred embodiments of the present invention, it is possible to provide internal combustion engines that each allows easy installment of a support that supports a rocker arm while preventing fretting wear, or the like, due to rising of the support, and vehicles including the same.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
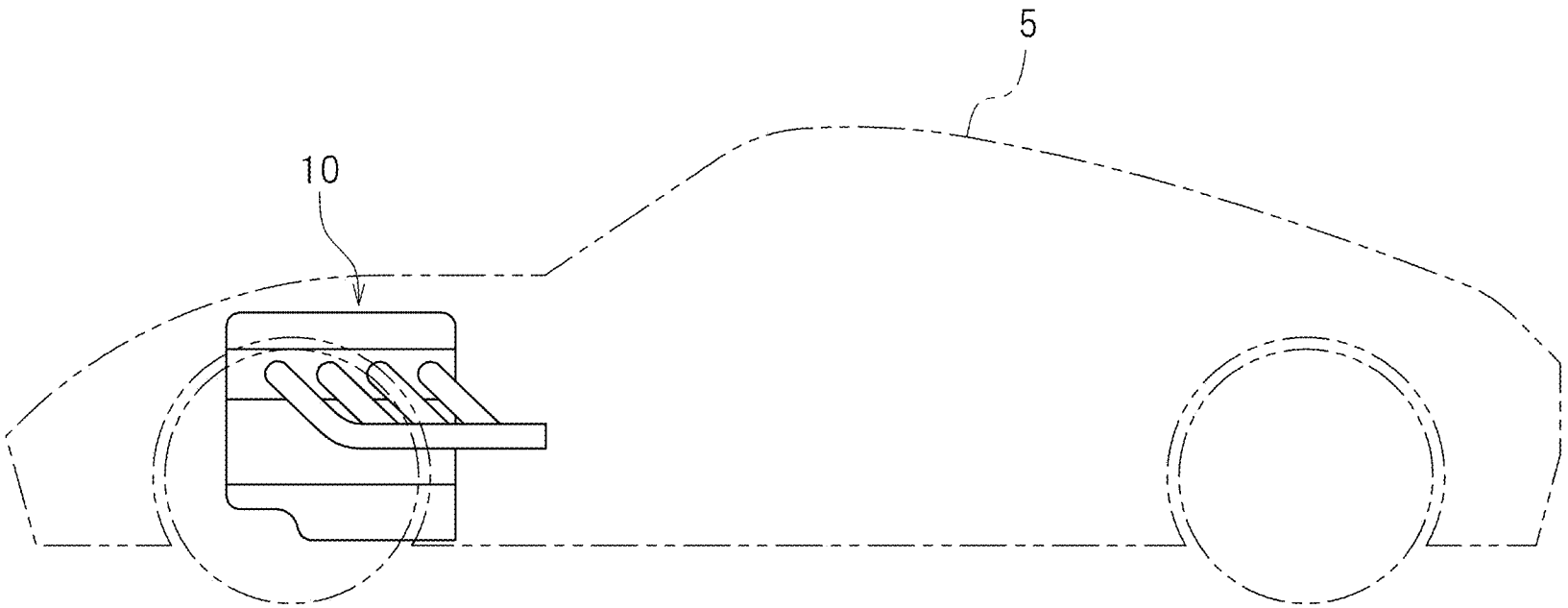
FIG. 1 is a view showing an example of an internal combustion engine according to a preferred embodiment of the present invention installed in an automobile.

Preferred embodiments of the present invention will now be described with reference to the drawings. An internal combustion engine according to the present preferred embodiment is installed in a vehicle and used as the drive source of the vehicle. There is no limitation on the type of the vehicle, which may be a straddled vehicle such as a motorcycle, an auto tricycle or an ATV (All Terrain Vehicle) or may be an automobile. For example, an internal combustion engine 10 may be provided in the engine room of an automobile 5 as shown in FIG. 1.

Figure 2:
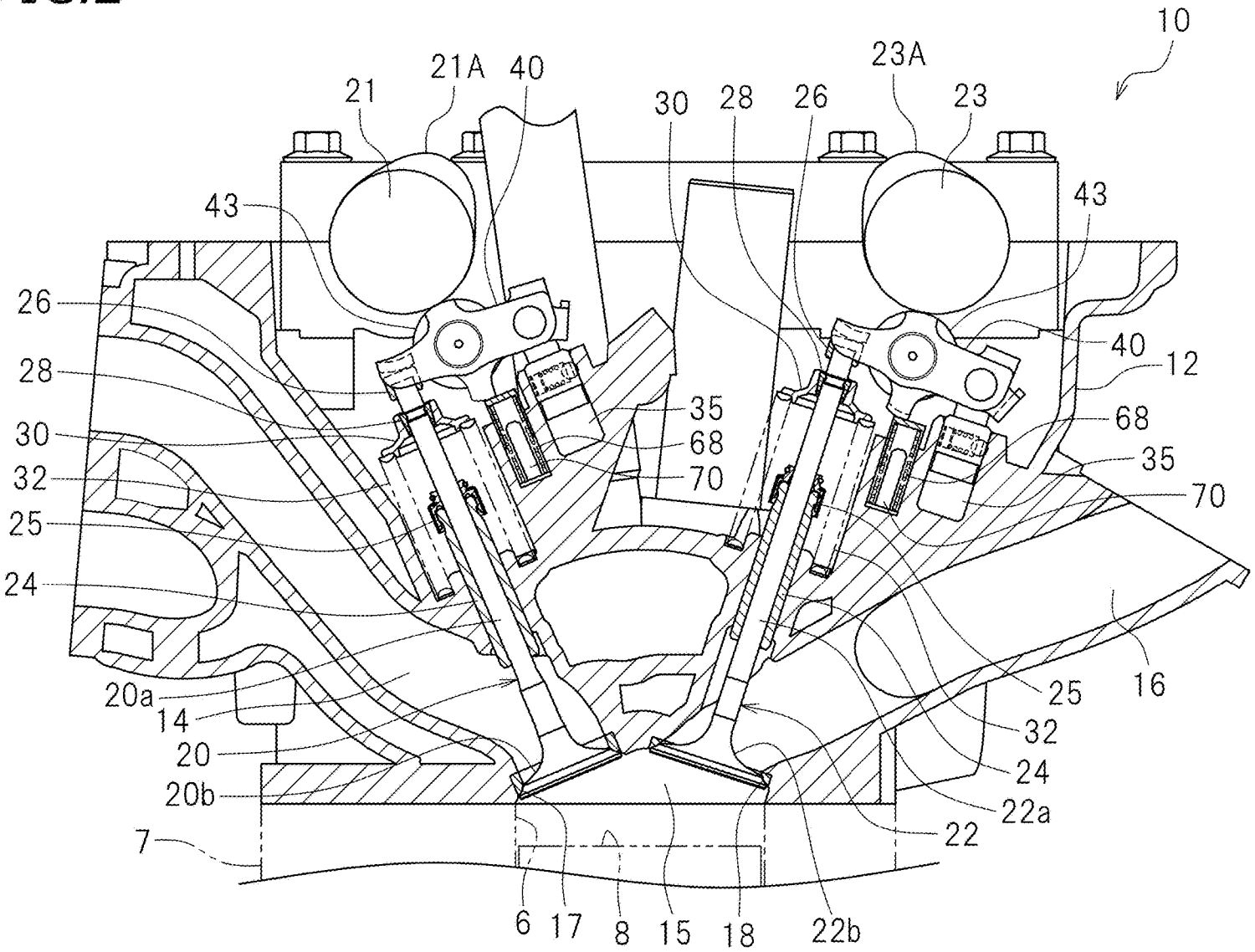
FIG. 2 is a partial cross-sectional view of the internal combustion engine.

The internal combustion engine 10 according to the present preferred embodiment is preferably a multi-cylinder engine including a plurality of cylinders. The internal combustion engine 10 is a 4-stroke engine that goes through the intake stroke, the compression stroke, the combustion stroke, and the exhaust stroke. FIG. 2 is a partial cross-sectional view of the internal combustion engine 10. As shown in FIG. 2, the internal combustion engine 10 includes a crankcase (not shown), a cylinder body 7 connected to the crankcase, and a cylinder head 12 connected to the cylinder body 7. A crankshaft (not shown) is located inside the crankcase. A plurality of cylinders 6 are provided inside the cylinder body 7. A piston 8 is located inside each cylinder 6. The piston 8 and the crankshaft are connected by a connecting rod (not shown).

An intake cam shaft 23 and an exhaust cam shaft 21 are rotatably supported on the cylinder head 12. Intake cams 23A are provided on the intake cam shaft 23, and exhaust cams 21A are provided on the exhaust cam shaft 21.

Intake ports 16 and exhaust ports 14 are provided in the cylinder head 12. An intake opening 18 is provided at one end of the intake port 16. An exhaust opening 17 is provided on one end of the exhaust port 14. The intake port 16 communicates with a combustion chamber 15 through the intake opening 18. The exhaust port 14 communicates with the combustion chamber 15 through the exhaust opening 17. The intake port 16 guides the mixed gas of the air and the fuel into the combustion chamber 15. The exhaust port 14 guides the exhaust gas discharged from the combustion chamber 15 to the outside.

Intake valves 22 and exhaust valves 20 are installed in the cylinder head 12. The intake valve 22 opens/closes the intake opening 18 of the intake port 16. The exhaust valve 20 opens/closes the exhaust opening 17 of the exhaust port 14. The intake valve 22 and the exhaust valve 20 are so-called poppet valves. The intake valve 22 includes a shaft portion 22*a* and an umbrella portion 22*b*, and the exhaust valve 20 includes a shaft portion 20*a* and an umbrella portion 20*b*. The configuration of the intake valve 22 and the configuration of the exhaust valve 20 are similar to each other, and the configuration of the intake valve 22 will be described below while omitting the description of the configuration of the exhaust valve 20. The shaft portion 22*a* of the intake valve 22 is slidably supported on the cylinder head 12 with a cylinder-shaped sleeve 24 therebetween. A valve stem seal 25 is attached to one end of the sleeve 24 and the shaft portion 22*a* of the intake valve 22. The shaft portion 22*a* of the intake valve 22 extends through the sleeve 24 and the valve stem seal 25. A tappet 26 is fitted to the tip of the shaft portion 22*a*.

Figure 3:
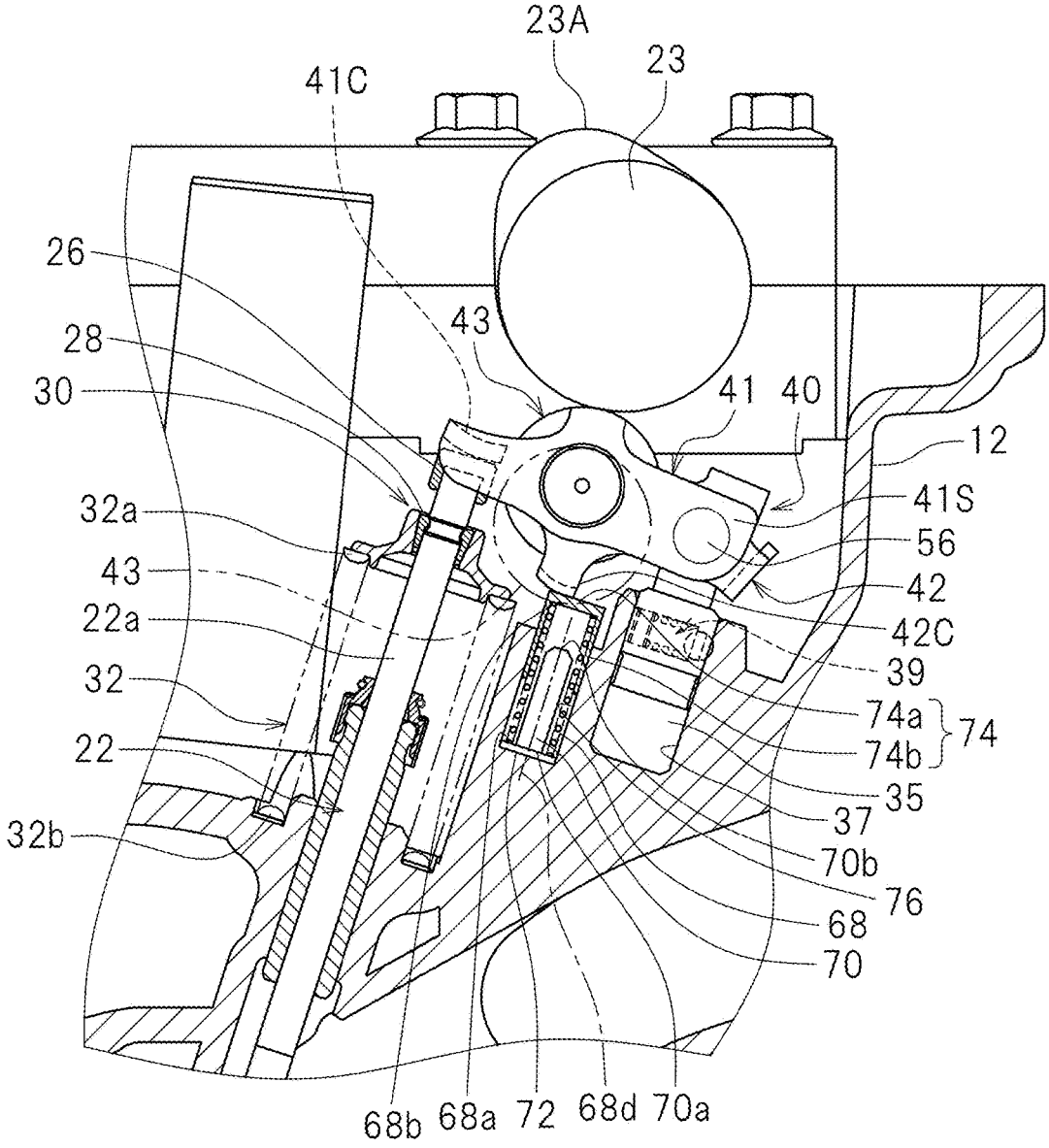
FIG. 3 is a partial enlarged cross-sectional view of the internal combustion engine.

As shown in FIG. 3, a cotter 28 is attached to the shaft portion 22*a* of the intake valve 22. The cotter 28 is fitted to a valve spring retainer 30. The valve spring retainer 30 is secured to the intake valve 22 with the cotter 28 therebetween. The valve spring retainer 30 is able to move, together with the intake valve 22, in an axial direction of the intake valve 22. The intake valve 22 extends through the valve spring retainer 30.

The internal combustion engine 10 includes a valve spring 32 that provides the intake valve 22 with a force in the direction of closing the intake opening 18 (the upward direction in FIG. 3). The valve spring 32 is preferably a compression coil spring, and includes a first spring end portion 32*a* supported on the valve spring retainer 30 and a second spring end portion 32*b* supported on the cylinder head 12.

Figure 4:
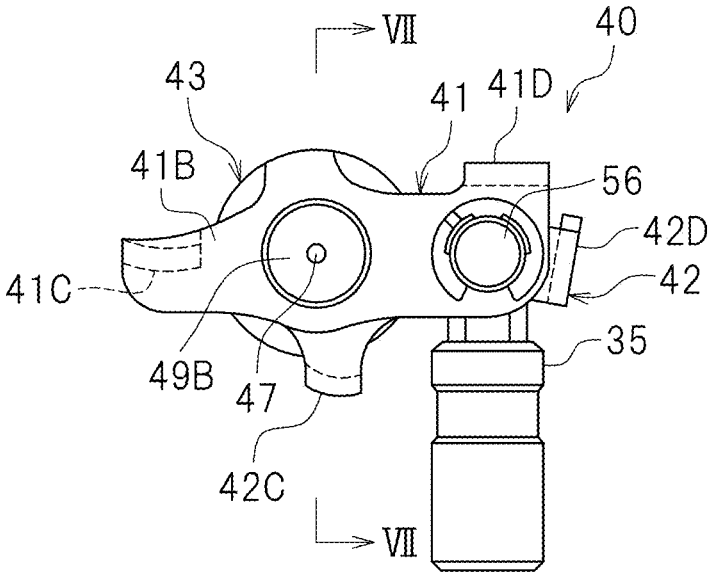
FIG. 4 is a side view of a rocker arm and a support.
Figure 5:
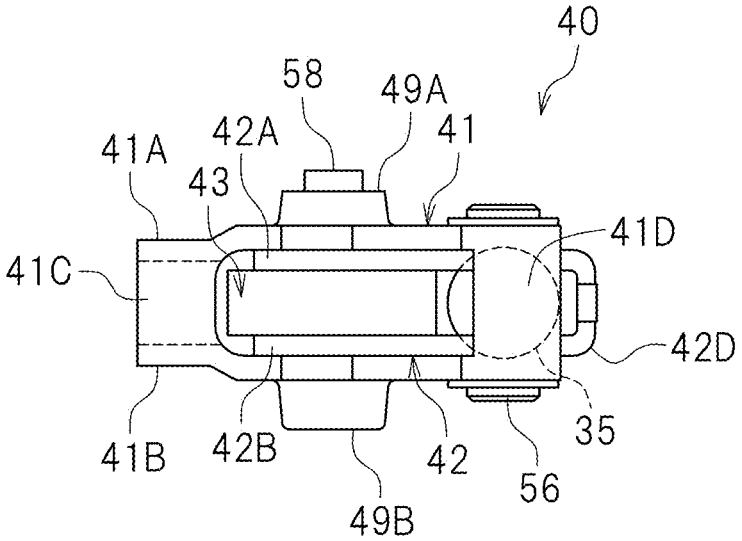
FIG. 5 is a plan view of the rocker arm and the support.

The internal combustion engine 10 includes a rocker arm 40 that receives a force from the intake cam 23A to open/close the intake valve 22. The rocker arm 40 is pivotally supported on the cylinder head 12 with a support 35 therebetween. FIG. 4 is a side view of the rocker arm 40 and the support 35, and FIG. 5 is a plan view of the rocker arm 40 and the support 35. The rocker arm 40 includes a first arm 41 and a second arm 42 including a roller 43.

Figure 6:
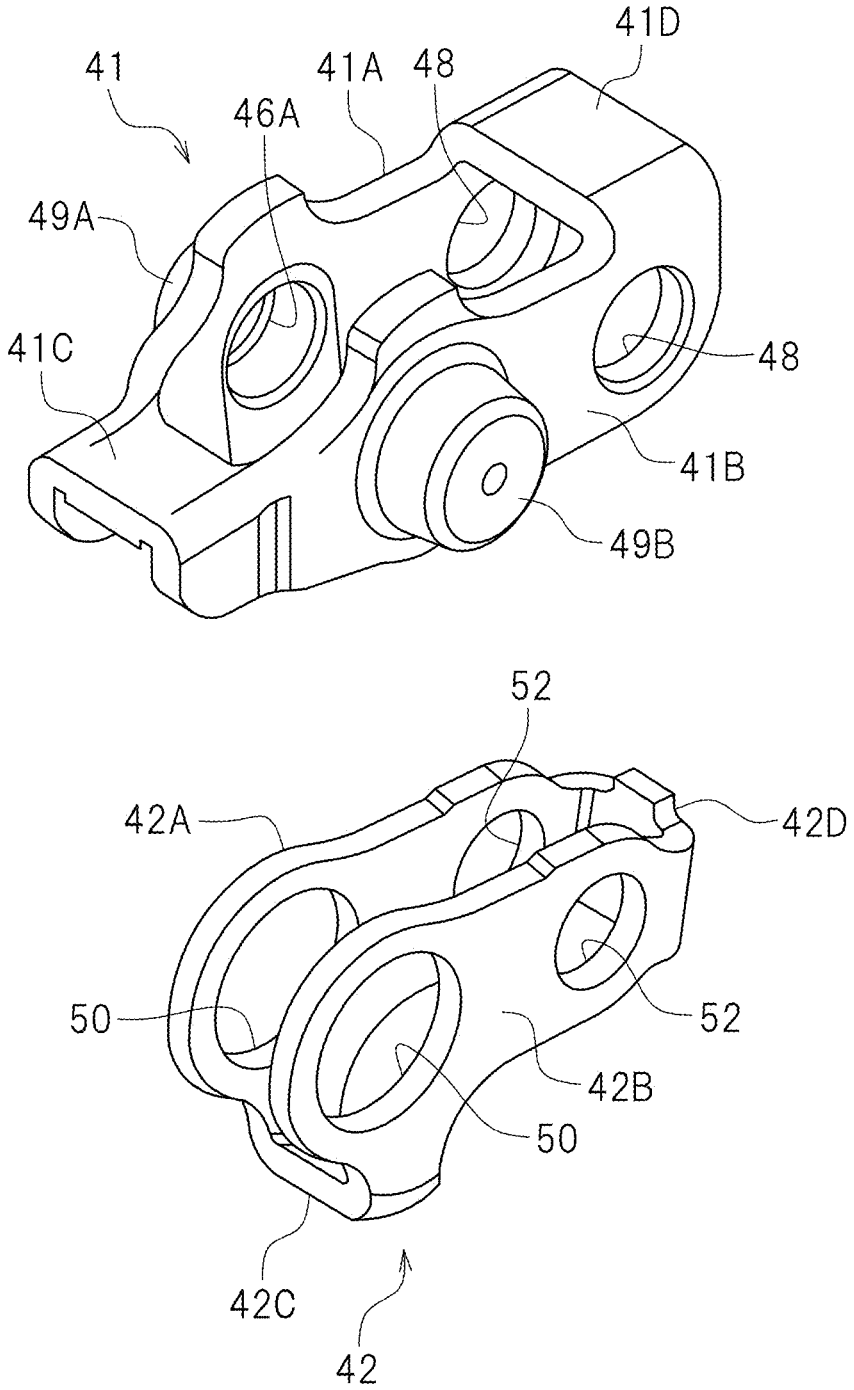
FIG. 6 is an exploded perspective view of a first arm and a second arm of the rocker arm.

FIG. 6 is an exploded perspective view of the first arm 41 and the second arm 42. The first arm 41 includes a plate 41A, a plate 41B, an abutting plate 41C, and a connecting plate 41D. The plate 41A and the plate 41B are parallel or substantially parallel to each other. The abutting plate 41C and the connecting plate 41D extend across the plate 41A and the plate 41B. The abutting plate 41C and the connecting plate 41D connect together the plate 41A and the plate 41B. The plate 41A includes a hole 46A and a hole 48. The plate 41B includes a hole 46B (see FIG. 7) and the hole 48. The holes 46A, 46B, and 48 extend in the direction parallel or substantially parallel to the axial line direction of the intake cam shaft 23 (see FIG. 3).

Figure 7:
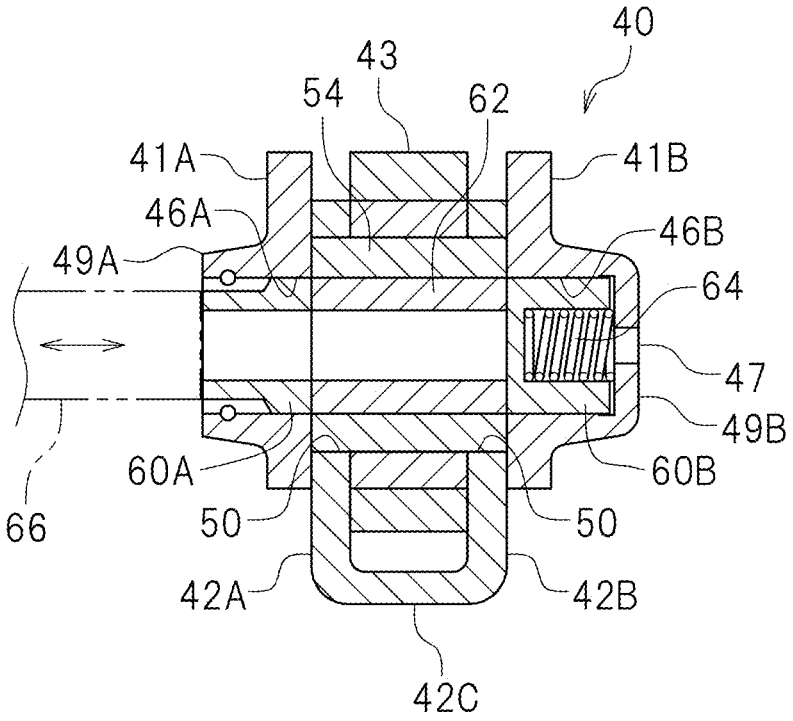
FIG. 7 is a cross-sectional view taken along line VII-VII of FIG. 4.

FIG. 7 is a cross-sectional view taken along line VII-VII of FIG. 4. As shown in FIG. 7, a cylinder-shaped boss portion 49A is provided around the hole 46A of the plate 41A. A connecting pin 60A is slidably inserted inside the hole 46A. A bottomed cylinder-shaped cover portion 49B is provided around the hole 46B of the plate 41B. The cover portion 49B is provided with a hole 47 having a smaller diameter than the hole 46B, but the hole 47 may be omitted. A connecting pin 60B is slidably inserted inside the hole 46B. A spring 64 is located inside the hole 46B. The spring 64 is present between the cover portion 49B and the connecting pin 60B, and urges the connecting pin 60B toward the plate 41A.

The second arm 42 is located on the inner side of the first arm 41. That is, the second arm 42 is located between the plate 41A and the plate 41B. As shown in FIG. 6 the second arm 42 includes a plate 42A, a plate 42B, an abutting plate 42C, and a connecting plate 42D. The plate 42A and the plate 42B are parallel or substantially parallel to each other. The abutting plate 42C and the connecting plate 42D extend across the plate 42A and the plate 42B. The abutting plate 42C and the connecting plate 42D connect together the plate 42A and the plate 42B. The plate 42A and the plate 42B include a hole 50 and a hole 52, respectively.

As shown in FIG. 7, the cylinder-shaped roller 43 is rotatably supported on the hole 50 of the plate 42A and the hole 50 of the plate 42B. Specifically, a cylinder-shaped collar 54 is inserted through the holes 50 of the plate 42A and the plate 42B. The roller 43 is rotatably supported on the collar 54. A connecting pin 62 is slidably inserted inside the collar 54. Since the collar 54 is located inside the holes 50, the connecting pin 62 is slidably inserted inside the holes 50. Note that the collar 54 is not always necessary. The connecting pin 62 may rotatably support the roller 43.

An outer diameter of the connecting pin 60B is less than or equal to an inner diameter of the collar 54. The connecting pin 60B is able to be inserted inside the collar 54. An outer diameter of the connecting pin 62 is less than or equal to an inner diameter of the hole 46A. The connecting pin 62 is able to be inserted inside the hole 46A. In the present preferred embodiment, the inner diameter of the collar 54 and the inner diameter of the hole 46A are equal or substantially equal to each other. The outer diameter of the connecting pin 60B, the outer diameter of the connecting pin 62 and an outer diameter of the connecting pin 60A are equal or substantially equal to each other.

As shown in FIG. 4, the support 35, the first arm 41, and the second arm 42 are connected together by a support pin 56. The support pin 56 is inserted through the hole 48 of the plate 41A and the hole 48 of the plate 41B of the first arm 41, and the hole 52 of the plate 42A and the hole 52 of the plate 42B of the second arm 42. The first arm 41 and the second arm 42 are pivotally supported on the support 35 by the support pin 56. The second arm 42 is pivotally supported on the first arm 41 by the support pin 56.

As shown in FIG. 7, a connection switch pin 66 is located on the side of the rocker arm 40. The connection switch pin 66 is movable in the direction toward the connecting pin 60A and in the direction away from the connecting pin 60A.

Figure 8:
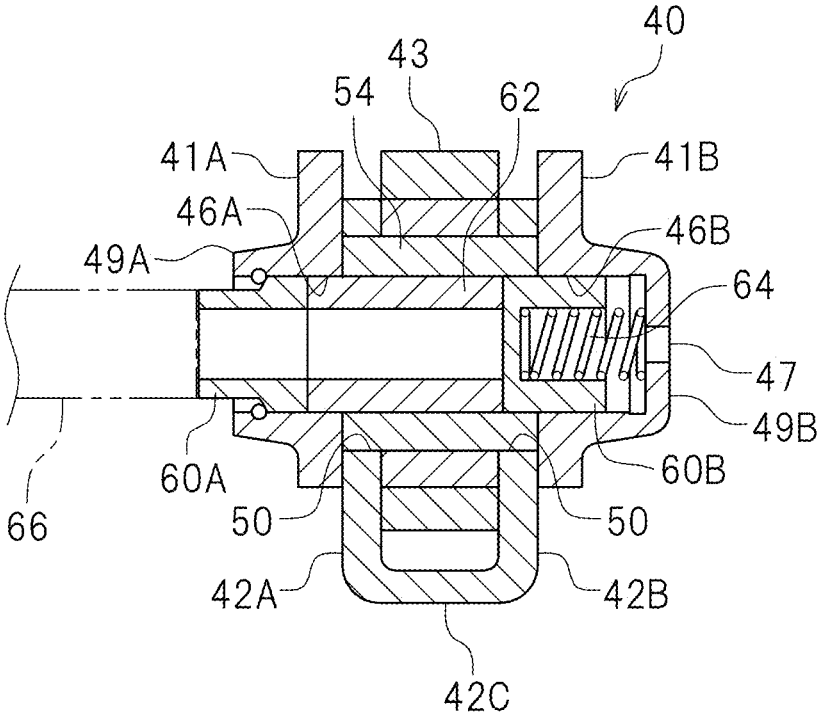
FIG. 8 is equivalent to FIG. 7, showing the rocker arm in the connected state.
Figure 9:
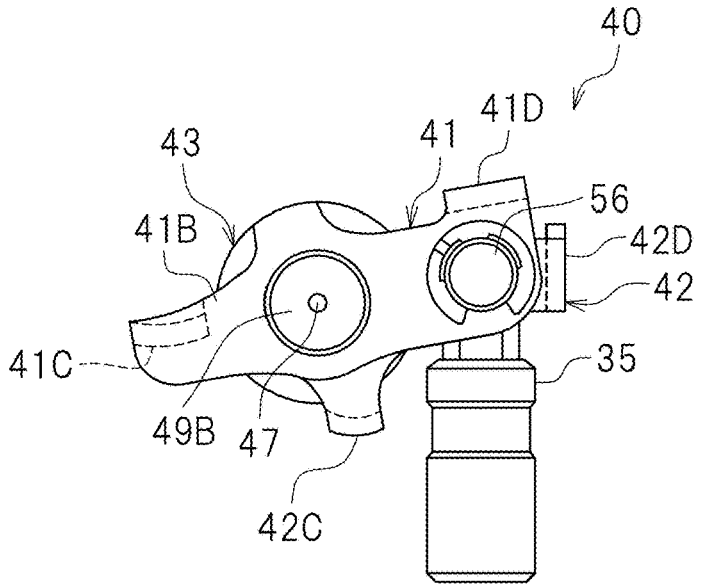
FIG. 9 is a side view showing the rocker arm in the connected state that has pivoted relative to the support.

As shown in FIG. 8, when the connection switch pin 66 moves in the direction away from the connecting pin 60A, the connecting pins 60A, 62 and 60B slide leftward in FIG. 8 due to the force of the spring 64. Thus, the connecting pin 60B is located inside the hole 46B and inside the hole 50 (specifically, inside the collar 54), and the connecting pin 62 is located inside the hole 50 (specifically, inside the collar 54) and inside the hole 46A. This state will hereinafter be referred to as the connected state. In the connected state, the first arm 41 and the second arm 42 are connected together by the connecting pin 60B and the connecting pin 62. As a result, as shown in FIG. 9, the first arm 41 and the second arm 42 are, as a single unit, pivotable about the axis of the support pin 9.

Figure 10:
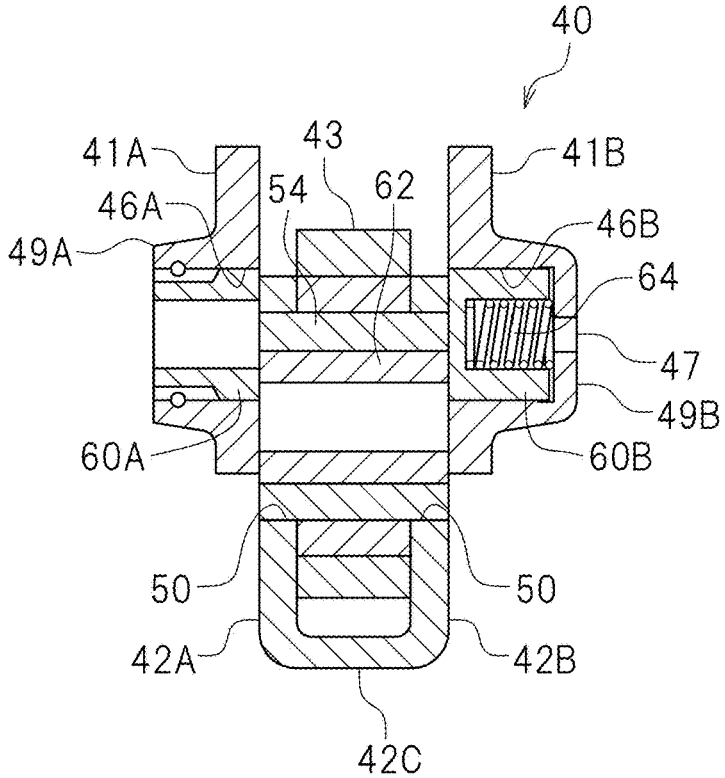
FIG. 10 is equivalent to FIG. 7, showing the rocker arm when the second arm pivots relative to the first arm.
Figure 11:
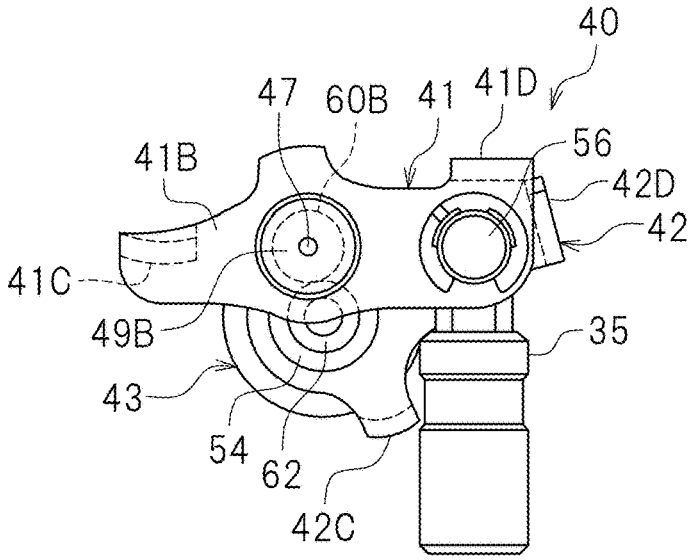
FIG. 11 is a side view showing the rocker arm and the support when the second arm pivots relative to the first arm.

As shown in FIG. 7, the connection switch pin 66 moves toward the connecting pin 60A, the connecting pins 60A, 62 and 60B are pushed by the connection switch pin 66 and slide rightward in FIG. 7. Thus, the connecting pin 60B is located inside the hole 46B and not located inside the hole 50, and the connecting pin 62 is located inside the hole 50 and not located inside the hole 46A. This state will hereinafter be referred to as the non-connected state. In the non-connected state, as shown in FIG. 10, the connecting pin 62 is slidable relative to the connecting pin 60A and the connecting pin 60B. As a result, as shown in FIG. 11, the second arm 42 is pivotable about the axis of the support pin 56 relative to the first arm 41. Therefore, the second arm 42 pivots about the axis of the support pin 56 while the first arm 41 does not pivot.

As shown in FIG. 3, the portion of the first arm 41 that is supported by the support pin 56 (specifically, the portion of the plate 41A around the hole 48 and the portion of the plate 41B around the hole 48) defines a supported portion 41S that is pivotally supported on the cylinder head 12. The abutting plate 41C defines an "abutting portion" that abuts on the intake valve 22 with the tappet 26 therebetween. The roller 43 defines a "pressed portion" that is in contact with the intake cam 23A and is pressed by the intake cam 23A.

As shown in FIG. 3, the support 35 that pivotally supports the rocker arm 40 is inserted into a hole 37 in the cylinder head 12. In the present preferred embodiment, the cylinder head 12 corresponds to the "cylinder". Note, however, that a cam carrier (not shown) may be attached to the cylinder head 12, and the hole 37, through which the support 35 is inserted, may be provided in the cam carrier. In such a case, the cylinder head 12 and the cam carrier, combined together, correspond to the "cylinder". Thus, another member may be attached to the cylinder head 12, and the hole 37 may be provided in that member. In such a case, the cylinder head 12 and the other member, combined together, correspond to the "cylinder". In the present preferred embodiment, the support 35 preferably has a circular columnar shape. Note, however, that the support 35 is not limited to a circular columnar shape, but may have a polygonal columnar shape, for example, or any other columnar shape. The hole 37 preferably has a cross-sectional shape that corresponds to the cross-sectional shape of the support 35.

Figure 12A:
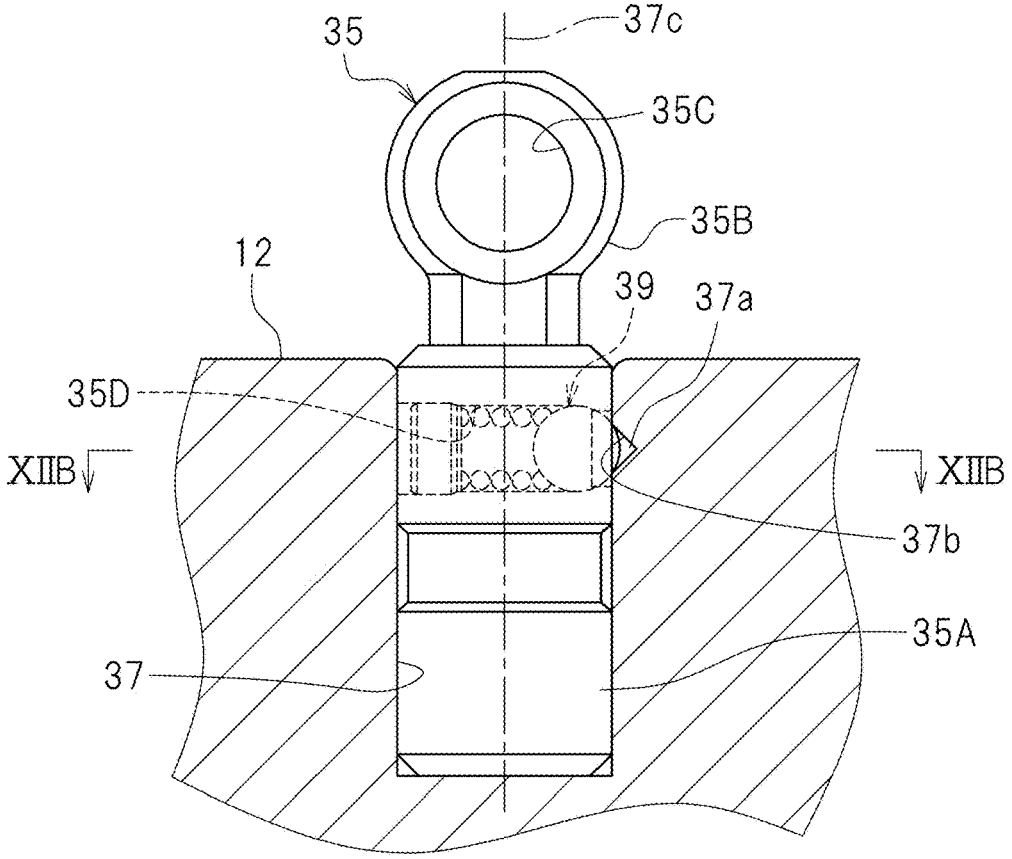
FIG. 12A is a side view of a support.
Figure 12B:
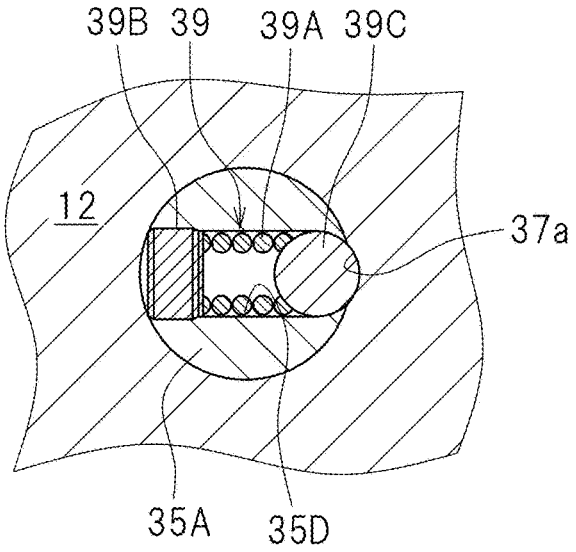
FIG. 12B is a cross-sectional view taken along line XIIb-XIIb of FIG. 12A.

FIG. 12A is a side view of the support 35. FIG. 12B is a cross-sectional view taken along line XIIb-XIIb of FIG. 12A. As shown in FIG. 12A, the support 35 includes a shaft portion 35A at least a portion of which is inserted into the hole 37, and a ring portion 35B includes a hole 35C through which the support pin 56 (see FIG. 3) is inserted. A ball plunger 39 is provided inside the shaft portion 35A as a retainer that secures the support 35 in the hole 37.

As shown in FIG. 12B, the shaft portion 35A of the support 35 includes a hole 35D extending in the radial direction. The ball plunger 39 is fitted in the hole 35D. The ball plunger 39 includes a spring 39A that is a compression coil spring, a spring seat 39B that is connected to one end of the spring 39A, and a ball 39C that is connected to the other end of the spring 39A. While the ball 39C is an example of a presser of a plunger, the presser is not limited to the ball 39C but may be a pin, etc. A portion of the ball 39C is exposed on the outside of the hole 35D. The inner circumferential surface of the hole 37 of the cylinder head 12 includes a groove 37*a* that engages with the ball 39C.

Figure 13:
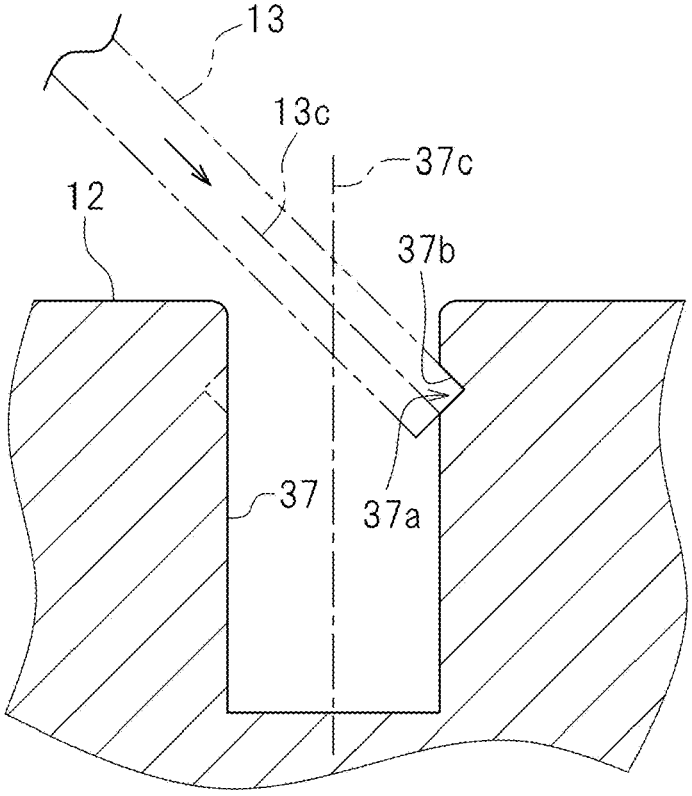
FIG. 13 is a cross-sectional view of a hole of a cylinder head.

Although there is no limitation on the shape of the groove 37*a*, the groove 37*a* preferably includes a sloped surface 37*b* as shown in FIG. 13 in the present preferred embodiment. As shown in FIG. 13, in a cross section that passes through the groove 37*a* and includes a center line 37*c* of the hole 37, the sloped surface 37*b* is inclined relative to the center line 37*c* and extends toward the center line 37*c* as it extends toward the rocker arm 40 along the direction of the center line 37*c* of the hole 37 (i.e., upward in FIG. 13).

The groove 37*a* is cone-shaped or circular columnar-shaped and includes an axis 13*c* that is inclined relative to the center line 37*c* of the hole 37. The groove 37*a* according to the present preferred embodiment is easily machined by inserting a tool 13 such as a drill or an endmill into the hole 37 in a direction that is slanted relative to the center line 37*c*.

With the internal combustion engine 10 according to the present preferred embodiment, the support 35 is not screwed onto the cylinder head 12. The support 35 is easily attached to the cylinder head 12 by inserting the support 35 into the hole 37. Specifically, by positioning the shaft portion 35A of the support 35 above the hole 37 and inserting the shaft portion 35A into the hole 37, the ball 39C is pushed by the inner circumferential surface of the hole 37, thus compressing the spring 39A. When the shaft portion 35A is inserted to a predetermined position, the ball 39C engages with the groove 37*a*. Then, the operator feels a clicking feel and thus easily knows that the shaft portion 35A has been inserted to a predetermined position. Therefore, the support 35 is easily positioned, and the support 35 is unlikely to come out of the hole 37. With the elastic force generated by the compression of the spring 39A, the ball 39C is pressed against the inner circumferential surface of the hole 37. The pressure with which the ball 39C presses the inner circumferential surface of the hole 37 secures the support 35 inside the hole 37.

Note that in the present preferred embodiment, the spring seat 39B is an example of the first contact portion in contact with the support 35. The ball 39C is an example of the second contact portion in contact with the cylinder head 12. The spring 39A is present between the spring seat 39B and the ball 39C, and is an example of the elastic portion.

As shown in FIG. 3, the internal combustion engine 10 includes a compression coil spring 68, as a lost motion spring, that urges the rocker arm 40 toward the intake cam 23A. A shaft 70 that extends along a winding axis 68*d* of the compression coil spring 68 is located inside the compression coil spring 68. The shaft 70 includes a first end portion 70*a*, and a second end portion 70*b* that is located on the second arm 42 side relative to the first end portion 70*a*. A spring seat 72 that receives the compression coil spring 68 is provided at the first end portion 70*a*.

The compression coil spring 68 includes a first end portion 68*a*, and a second end portion 68*b* that is located on the second arm 42 side relative to the first end portion 68*a*. A spring retainer 74 is supported at the second end portion 68*b*. The spring retainer 74 includes a disc-shaped top plate portion 74*a* and a cylinder-shaped tube portion 74*b*. The tube portion 74*b* extends from the top plate portion 74*a* along the axial direction of the shaft 70 toward the compression coil spring 68. The top plate portion 74*a* is supported on the second end portion 68*b* of the compression coil spring 68. The top plate portion 74*a* is in contact with the abutting plate 42C of the second arm 42 of the rocker arm 40.

The spring seat 72, at least a portion of the shaft 70, at least a portion of the compression coil spring 68, and at least a portion of the tube portion 74*b* of the spring retainer 74 are located inside a hole 76 in the cylinder head 12.

The intake valve 22, the valve spring 32, the shaft 70, the spring retainer 74, the compression coil spring 68, and the support 35 are parallel or substantially parallel to each other. The spring retainer 74 is located between the valve spring 32 and the support 35. The shaft 70 is located between the valve spring 32 and the support 35.

As shown in FIG. 2, as with the intake valve 22, the valve spring 32, the valve spring retainer 30, the rocker arm 40, the support 35, the compression coil spring 68, etc., are provided also for the exhaust valve 20. These elements are similar to those described above, and will not be described in detail below.

With the internal combustion engine 10 according to the present preferred embodiment, it is possible to switch the operation state of the intake valve 22 and the exhaust valve 20 by switching the state of the connection switch pin 66.

That is, when the connection switch pin 66 is switched to the connected state, the first arm 41 and the second arm 42 of the rocker arm 40 are connected together by the connecting pin 60B and the connecting pin 62 (see FIG. 8). When the intake cam 23A pushes the roller 43 of the rocker arm 40 following the rotation of the intake cam shaft 23, the first arm 41 and the second arm 42, as a single unit, pivot about the axis of the support pin 56 (see FIG. 9). As a result, the abutting plate 41C of the first arm 41 pushes the intake valve 22, thus opening the intake opening 18 of the intake port 16. Similarly, when the exhaust cam 21A pushes the roller 43 of the rocker arm 40 following the rotation of the exhaust cam shaft 21, the first arm 41 and the second arm 42, as a single unit, pivot about the axis of the support pin 56. As a result, the abutting plate 41C of the first arm 41 pushes the exhaust valve 20, thus opening the exhaust opening 17 of the exhaust port 14.

When the connection switch pin 66 is switched to the non-connected state, the connection between the first arm 41 and the second arm 42 by the connecting pin 60B and the connecting pin 62 is disconnected (see FIG. 7). The second arm 42 becomes pivotable relative to the first arm 41 (see FIG. 10). When the intake cam 23A pushes the roller 43 following the rotation of the intake cam shaft 23, the second arm 42 pivots about the axis of the support pin 56 while the first arm 41 does not pivot (see FIG. 11). Therefore, the abutting plate 41C of the first arm 41 will not push the intake valve 22, and the intake opening 18 remains closed by the intake valve 22. Similarly, when the exhaust cam 21A pushes the roller 43 following the rotation of the exhaust cam shaft 21, the second arm 42 pivots about the axis of the support pin 56 while the first arm 41 does not pivot. Therefore, the abutting plate 41C of the first arm 41 will not push the exhaust valve 20, and the exhaust opening 17 remains closed by the exhaust valve 20. Thus, in the present preferred embodiment, one or more of a plurality of cylinders are able to be brought to the inoperative state by switching the connection switch pin 66 to the non-connected state. For example, by making one or more cylinders inoperative while the load is small, it is possible to improve the fuel efficiency.

As described above, with the internal combustion engine 10 according to the present preferred embodiment, the support 35 that pivotally supports the rocker arm 40 is not only inserted into the hole 37 of the cylinder head 12 but is also secured inside the hole 37 by the ball plunger 39. While the internal combustion engine 10 is running, the cam 21A, 23A repeatedly presses the rocker arm 40, and a load in the axial direction is repeatedly generated on the support 35. However, since the support 35 is secured inside the hole 37 by the ball plunger 39, it is possible to prevent the support 35 from rising from the hole 37. Therefore, it is possible to prevent fretting wear, or the like, due to rising of the support 35.

With the internal combustion engine 10, when the support 35 is pushed into the hole 37, the support 35 is inserted into the hole 37 and is then secured inside the hole 37 by the elastic force of the spring 39A of the ball plunger 39. With the internal combustion engine 10 according to the present preferred embodiment, there is no need for an operation of securing the support 35 to the cylinder head 12 by using screws, bolts, or the like. This makes easy the installment of the support 35.

Thus, with the internal combustion engine 10 according to the present preferred embodiment, it is possible to prevent fretting wear, or the like, due to rising of the support 35 while maintaining the ease of installment of the support 35.

Now, where the support 35 is able to contract/expand in the axial direction, such as a lash adjuster, the position of the rocker arm 40 changes following the contraction/expansion of the support 35. For example, when the support 35 expands, the rocker arm 40 moves toward the cam 21A, 23A (upward in FIG. 3). As a result, the position of the pivot center of the second arm 42 moves toward the cam 21A, 23A. On the other hand, since the position of the cam 21A, 23A does not change, the contact position between the roller 43 and the cam 21A, 23A does not change. Therefore, if the support 35 expands when the rocker arm 40 is in the non-connected state, the second arm 42 may not be able to return to the position where the hole 50 and the hole 46A, 46B are aligned with each other (the position shown in FIG. 7). Then, it is possible that the first arm 41 and the second arm 42 may not be properly connected together by the connecting pin 60B and the connecting pin 62, and the connecting function of the rocker arm 40 may possibly be difficult. However, in the present preferred embodiment, the support 35, as opposed to a lash adjuster, cannot expand/contract in the axial direction. The rocker arm 40 does not move toward the cam 21A, 23A. Therefore, it is possible to prevent difficulty in connecting the first arm 41 and the second arm 42 of the rocker arm 40.

Although there is no limitation on the retainer that secures the support 35 inside the hole 37 of the cylinder head 12, the present preferred embodiment includes the ball plunger 39, which includes the spring 39A located inside the support 35, and the ball 39C at least a portion of which is located outside the support 35. Therefore, the retainer is simple and compact. By appropriately setting the spring constant, etc., of the spring 39A, the ease of operation of inserting the support 35 into the hole 37 and the prevention of rising of the support 35 are achieved in a well-balanced manner.

With the internal combustion engine 10 according to the present preferred embodiment, the groove 37*a* that engages with the ball 39C of the ball plunger 39 is provided on the inner circumferential surface of the hole 37 of the cylinder head 12. Thus, when the support 35 is inserted into the hole 37, the ball 39C engages with the groove 37*a*, and the support 35 is even less likely to rise. Therefore, the ease of installment of the support 35 and the prevention of fretting wear, or the like, due to rising of the support 35 are both realized at a high level.

In the present preferred embodiment, the groove 37*a* includes the sloped surface 37*b* (see FIG. 13). Since the groove 37*a* includes the sloped surface 37*b*, the ball 39C of the ball plunger 39 is unlikely to come out of the groove 37*a*, and the support 35 is even less likely to rise. Therefore, it is possible to even better prevent fretting wear, or the like, due to rising of the support 35.

In the present preferred embodiment, the groove 37*a* is preferably cone-shaped or circular columnar-shaped and includes the axis 13*c* that is inclined relative to the center line 37*c* of the hole 37. According to the present preferred embodiment, the groove 37*a* is able to be machined by inserting the tool 13 such as a drill or an endmill into the hole 37 from outside the hole 37. Therefore, the groove 37*a* is formed in a simple and inexpensive manner.

Note that while the groove 37*a* may be provided only at one point in the circumferential direction of the hole 37, it may be provided in a circumferential pattern (see the phantom line in FIG. 13). Where the groove 37*a* is provided only at one point in the circumferential direction of the hole 37, if the position at which the groove 37*a* is machined is shifted in the circumferential direction, the position at which the support 35 is attached in the circumferential direction may possibly be shifted. However, where the groove 37*a* is provided in a circumferential pattern, the position at which the support 35 is attached in the circumferential direction is prevented from being shifted. Therefore, even if the machining precision of the groove 37*a* is relatively low, it is possible to properly machine the groove 37*a*. Thus, the groove 37*a* is provided in a simple and inexpensive manner.

While preferred embodiments of the present invention have been described above, it is needless to say that the present invention is not limited to the above-described preferred embodiments. Next, examples of alternative preferred embodiments will be described. First, an example of an alternative preferred embodiment using a different configuration of the retainer will be described.

Figure 14:
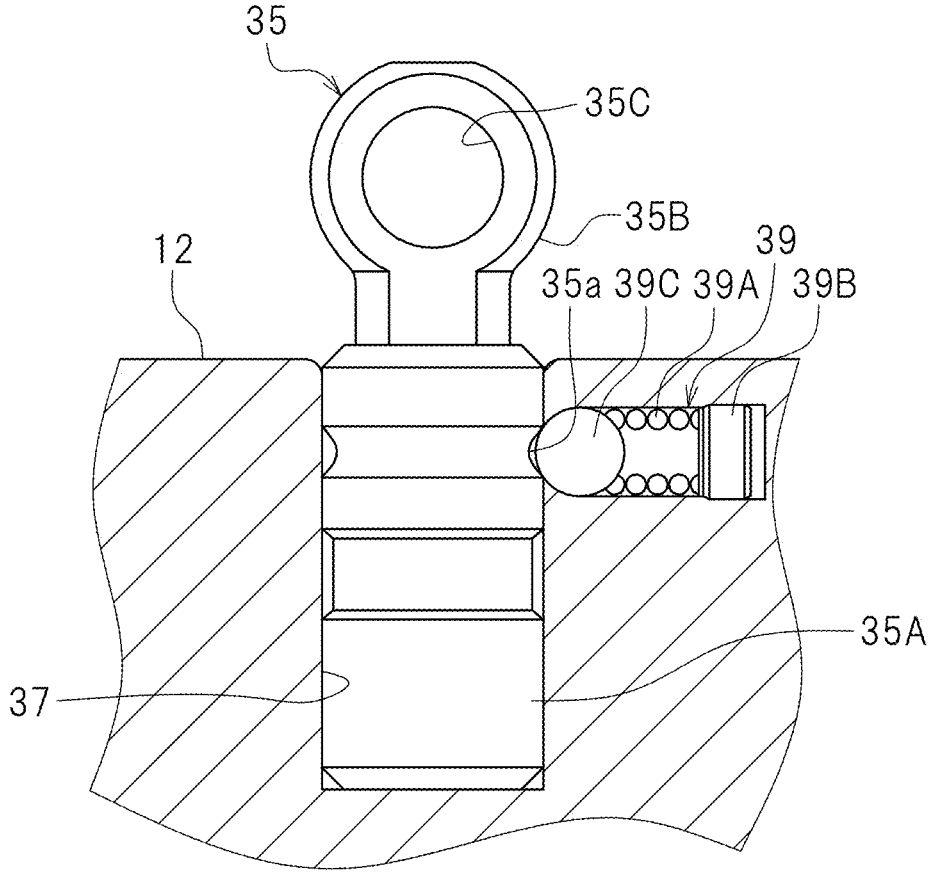
FIG. 14 is a side view of a support according to an alternative preferred embodiment of the present invention.

With the internal combustion engine 10 according to an alternative preferred embodiment shown in FIG. 14, the retainer includes the ball plunger 39 including the spring 39A and the spring seat 39B that are located inside the cylinder head 12, and the ball 39C at least a portion of which is located inside the hole 37. The spring 39A is a compression coil spring, wherein one end of the spring 39A is connected to the spring seat 39B and the other end thereof is connected to the ball 39C. A groove 35*a* that engages with the ball 39C is provided on the outer circumferential surface of the shaft portion 35A of the support 35. Note, however, that the groove 35*a* is not always necessary and may be omitted. In the present preferred embodiment, the ball 39C, the spring seat 39B, and the spring 39A correspond to the "first contact portion", the "second contact portion", and the "elastic portion", respectively.

Also in the present preferred embodiment, the support 35 is able to be secured inside the hole 37 by the ball plunger 39 simply by inserting the support 35 into the hole 37. It is possible to prevent fretting wear, or the like, due to rising of the support 35 while maintaining the ease of installment of the support 35. It is possible to prevent a negative impact on the connecting function of the rocker arm 40. By appropriately setting the spring constant, etc., of the spring 39A, the ease of operation of inserting the support 35 into the hole 37 and the prevention of rising of the support 35 are realized in a well-balanced manner. According to the present preferred embodiment, there is no need to install the ball plunger 39 inside the support 35, and it is possible to increase the degree of freedom in the position of installment of the retainer.

Figure 15A:
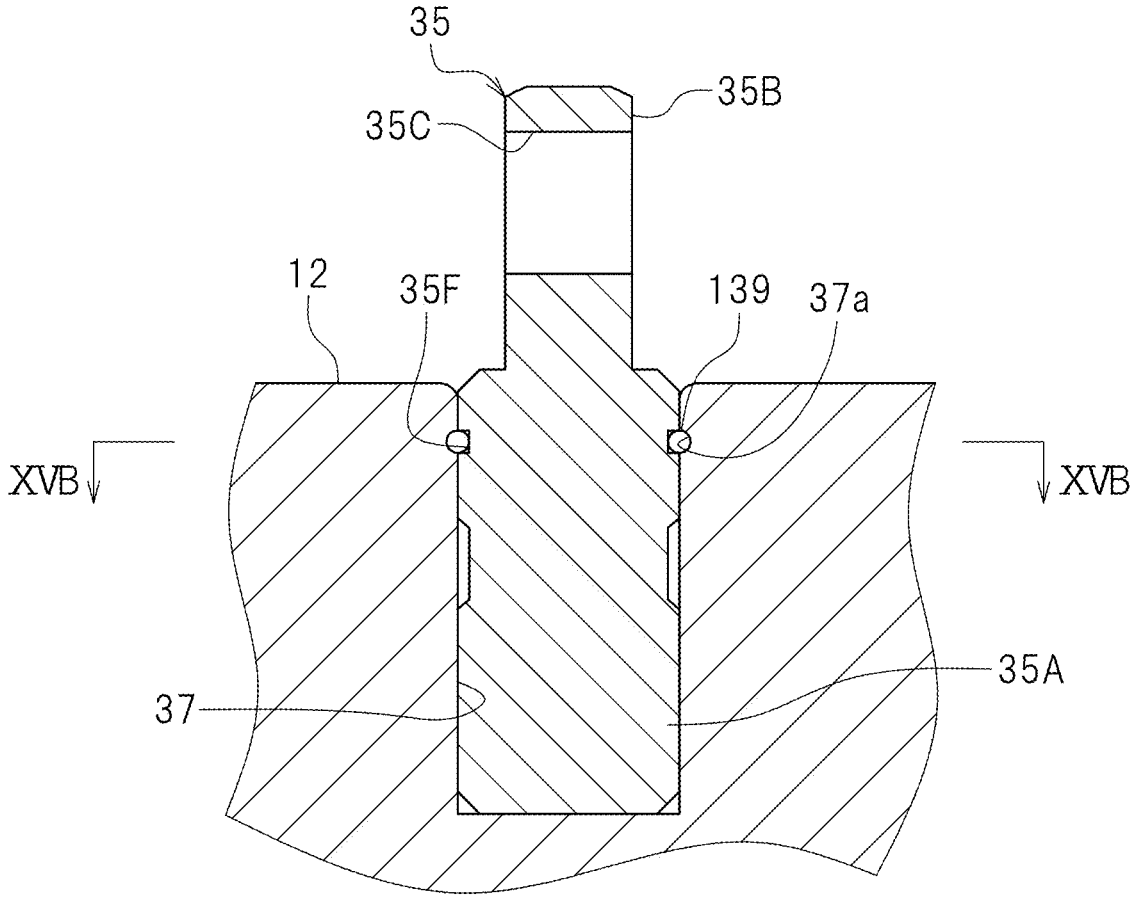
FIG. 15A is a cross-sectional view of a support according to an alternative preferred embodiment of the present invention.
Figure 15B:
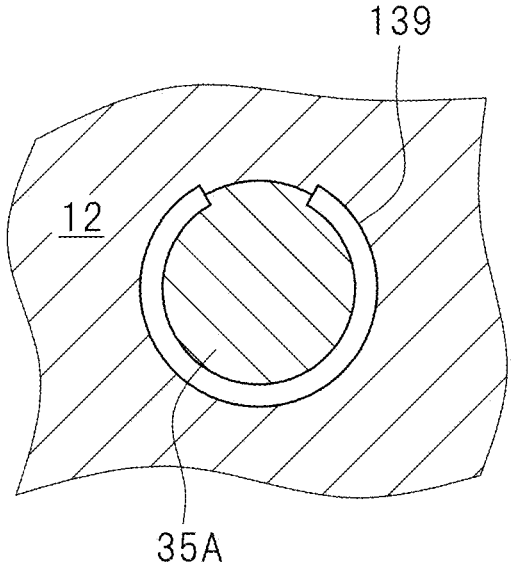
FIG. 15B is a cross-sectional view taken along line XVb-XVb of FIG. 15A.

As shown in FIG. 15A and FIG. 15B, with the internal combustion engine 10 according to an alternative preferred embodiment, the retainer includes a snap ring 139 fitted to the support 35. In the present preferred embodiment, a groove 35F is provided on the outer circumferential surface of the shaft portion 35A of the support 35, and the snap ring 139 is fitted to the groove 35F. The groove 37*a* that engages with the snap ring 139 is provided on the inner circumferential surface of the hole 37 of the cylinder head 12. Note, however, that the groove 37*a* is not always necessary and may be omitted. When the shaft portion 35A of the support 35 is inserted into the hole 37 of the cylinder head 12, the snap ring 139 is pressed by the inner circumferential surface of the hole 37 so as to elastically deform radially inward. In other words, the radius of the snap ring 139 decreases. By the elastic force generated following the deformation of the snap ring 139, the support 35 is pressed against the inner circumferential surface of the hole 37 with the snap ring 139 therebetween. Thus, the support 35 is secured inside the hole 37. According to the present preferred embodiment, the retainer includes the snap ring 139, and therefore the retainer is simple and compact.

Figure 16:
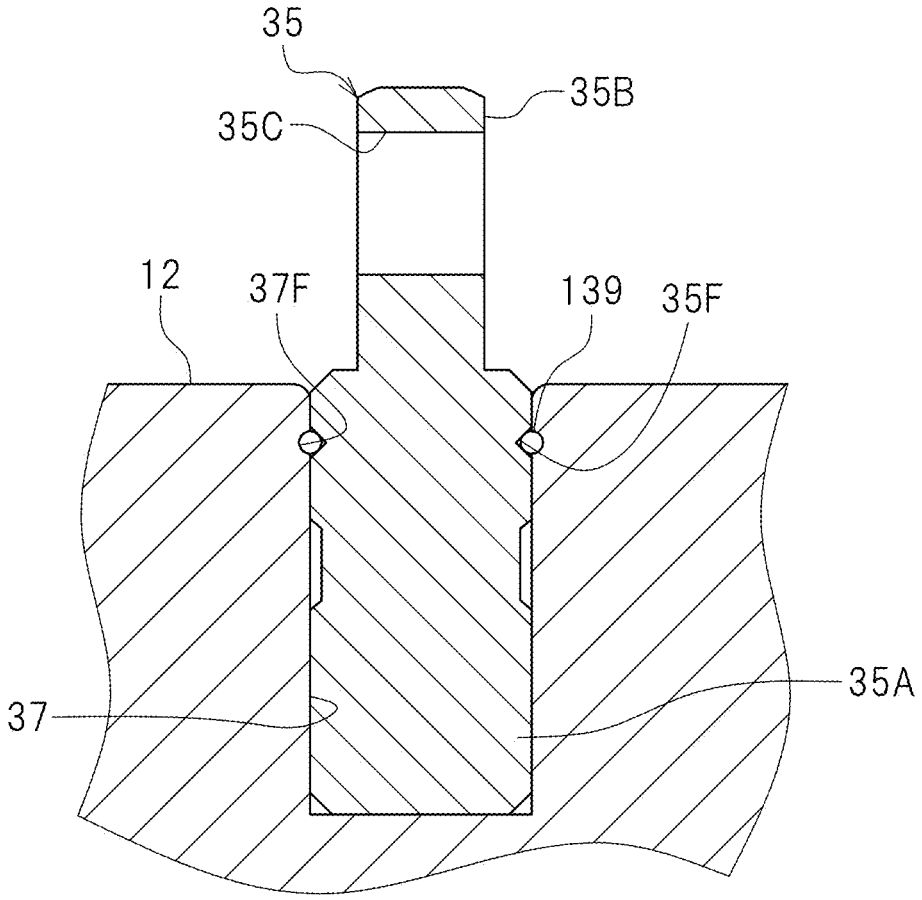
FIG. 16 is a cross-sectional view of a support according to an alternative preferred embodiment of the present invention.

As shown in FIG. 16, the snap ring 139 may be fitted to the inner circumferential surface of the hole 37 of the cylinder head 12 so that the snap ring 139 defines and functions as the retainer that secures the support 35. In the present preferred embodiment, a groove 37F is provided on the inner circumferential surface of the hole 37, and the retainer includes the snap ring 139 fitted into the groove 37F. The groove 35F that engages with the snap ring 139 is provided on the outer circumferential surface of the support 35. Note, however, that the groove 35F is not always necessary and may be omitted. In the present preferred embodiment, when the shaft portion 35A of the support 35 is inserted into the hole 37, the snap ring 139 elastically deforms radially outward by being pressed by the outer circumferential surface of the support 35. In other words, the radius of the snap ring 139 increases. By the elastic force generated following the deformation of the snap ring 139, the support 35 is pressed against the inner circumferential surface of the hole 37 with the snap ring 139 therebetween. Thus, the support 35 is secured inside the hole 37. Also in the present preferred embodiment, the retainer includes the snap ring 139, and therefore the retainer is simple and compact.

Figure 17A:
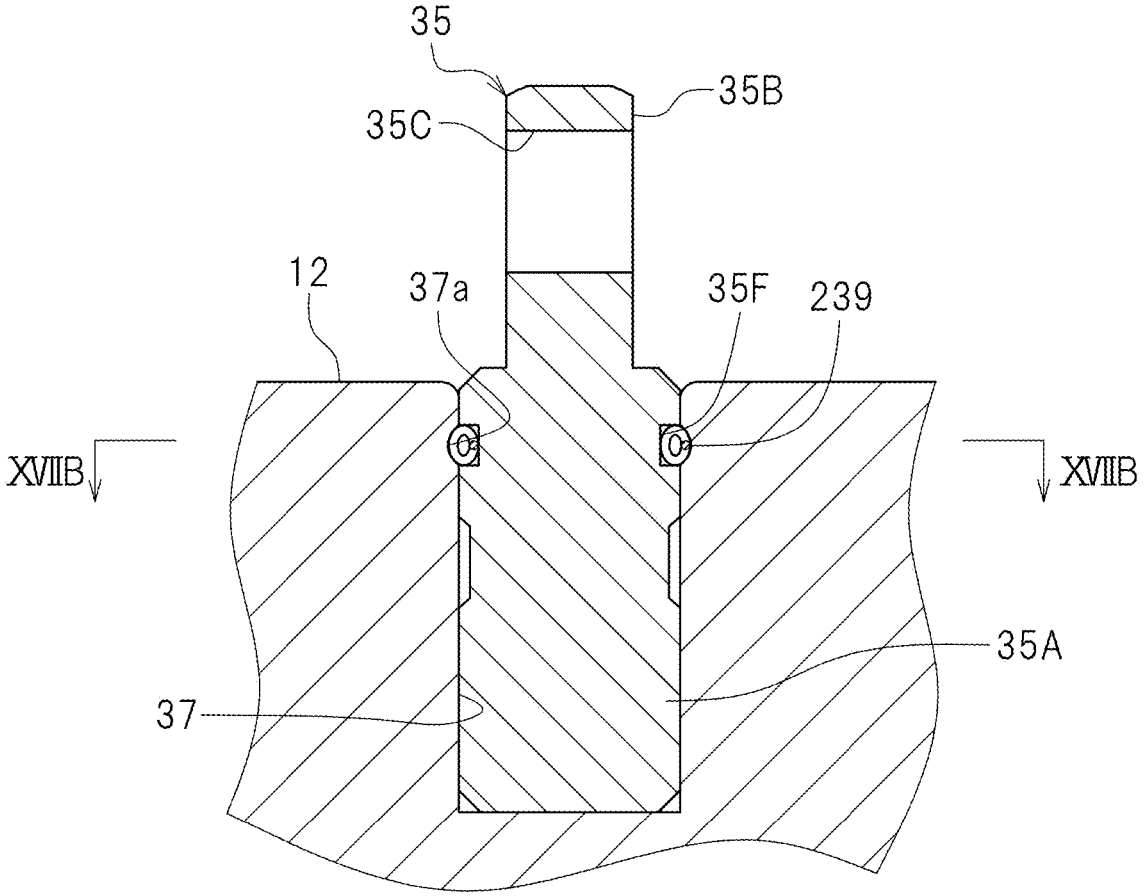
FIG. 17A is a cross-sectional view of a support according to an alternative preferred embodiment of the present invention.
Figure 17B:
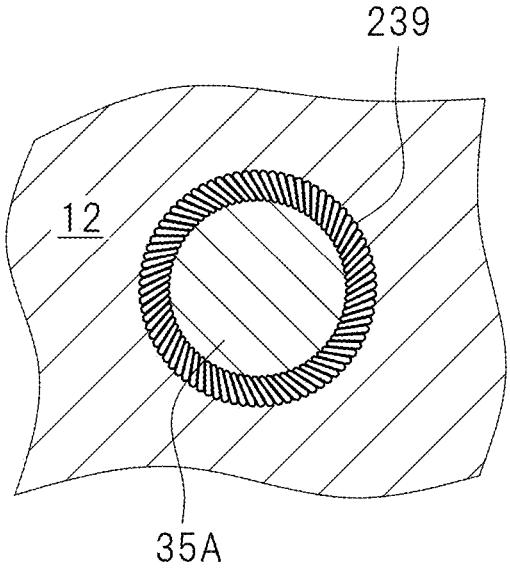
FIG. 17B is a cross-sectional view taken along line XVIIb-XVIIb of FIG. 17A.

As shown in FIG. 17A and FIG. 17B, with the internal combustion engine 10 according to an alternative preferred embodiment, the retainer includes a ring-shaped coil spring 239 wound around the support 35. In the present preferred embodiment, the groove 35F is provided on the outer circumferential surface of the shaft portion 35A of the support 35, and the ring-shaped coil spring 239 is fitted to the groove 35F. The groove 37*a* that engages with the coil spring 239 is provided on the inner circumferential surface of the hole 37 of the cylinder head 12. Note, however, that the groove 37*a* is not always necessary and may be omitted. When the shaft portion 35A of the support 35 is inserted into the hole 37, the ring-shaped coil spring 239 elastically deforms radially inward by being pressed by the inner circumferential surface of the hole 37. By the elastic force generated following the deformation of the coil spring 239, the support 35 is pressed against the inner circumferential surface of the hole 37 with the coil spring 239 therebetween. Thus, the support 35 is secured inside the hole 37. According to the present preferred embodiment, the retainer includes the ring-shaped coil spring 239, and therefore the retainer is simple and compact.

Figure 18:
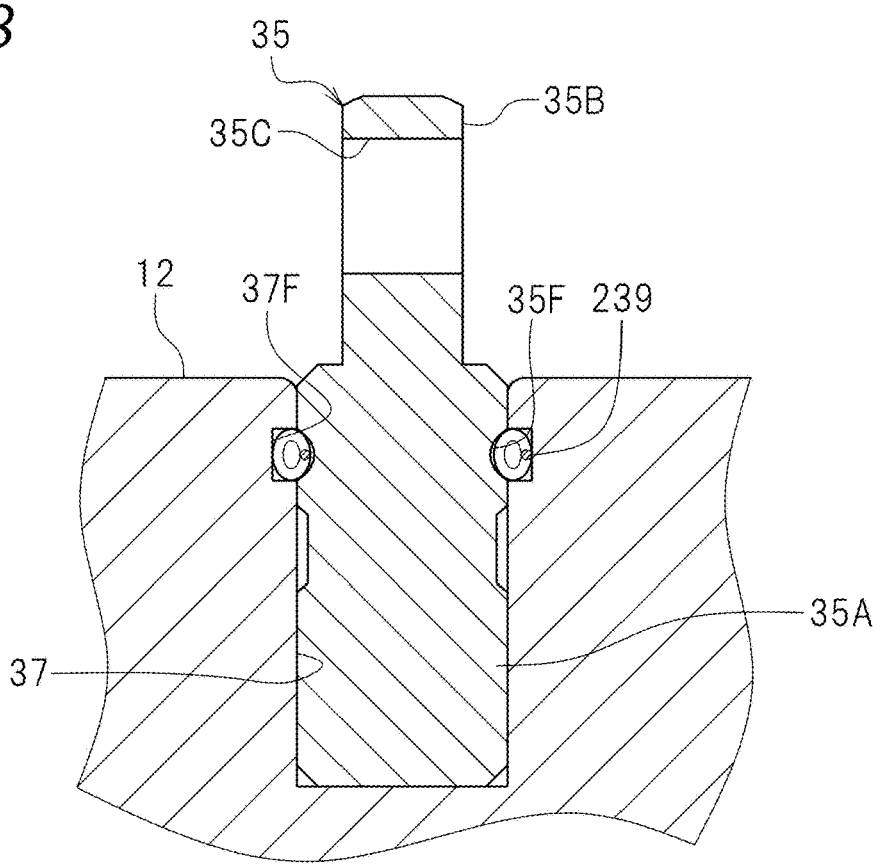
FIG. 18 is a cross-sectional view of a support according to an alternative preferred embodiment of the present invention.

As shown in FIG. 18, the ring-shaped coil spring 239 may be fitted to the inner circumferential surface of the hole 37 so that the coil spring 239 defines and functions as the retainer that secures the support 35. In the present preferred embodiment, the groove 37F is provided on the inner circumferential surface of the hole 37, and the retainer includes the ring-shaped coil spring 239 fitted to the groove 37F. The groove 35F that engages with the coil spring 239 is provided on the outer circumferential surface of the support 35. Note, however, that the groove 35F is not always necessary and may be omitted. In the present preferred embodiment, when the shaft portion 35A of the support 35 is inserted into the hole 37, the ring-shaped coil spring 239 elastically deforms radially outward by being pressed by the outer circumferential surface of the support 35. By the elastic force generated following the deformation of the coil spring 239, the support 35 is pressed against the inner circumferential surface of the hole 37 with the coil spring 239 therebetween. Thus, the support 35 is secured inside the hole 37. Also in the present preferred embodiment, the retainer includes the ring-shaped coil spring 239, and therefore the retainer is simple and compact.

Figure 19:
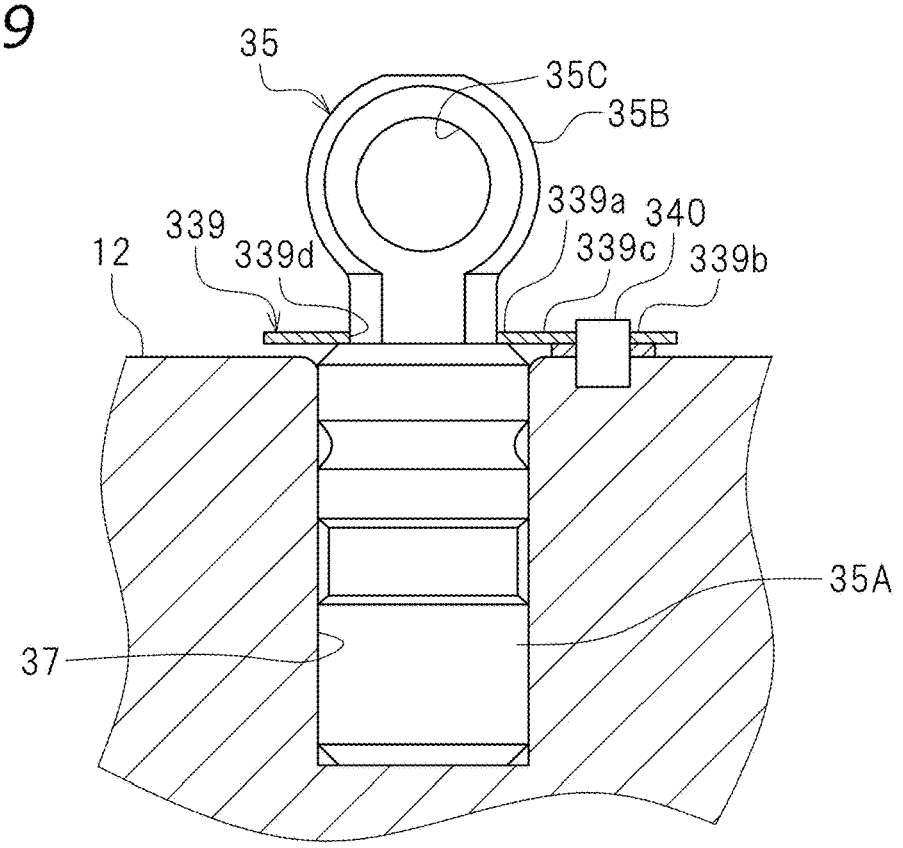
FIG. 19 is a side view of a support according to an alternative preferred embodiment of the present invention.

As shown in FIG. 19, the retainer may include a leaf spring 339 secured to the edge of the hole 37 of the cylinder head 12. Herein, the leaf spring 339 is secured to the cylinder head 12 by a pin 340. The leaf spring 339 includes a hole 339*d* through which the support 35 passes. The edge of the hole 339*d* of the leaf spring 339 is a first contact portion 339*a* that contacts with the support 35. A portion of the leaf spring 339 that is supported by the pin 340 is a second contact portion 339*b* that contacts with the cylinder head 12 with the pin 340 therebetween. A portion between the first contact portion 339*a* and the second contact portion 339*b* is an elastic portion 339*c*. According to the present preferred embodiment, the retainer includes the leaf spring 339, and therefore the retainer is simple.

In the preferred embodiments described above, the first arm 41 is configured so as not to be in contact with the cam 21A, 23A. In the preferred embodiments described above, the valve 20, 22 is brought into the inoperative state by switching the first arm 41 and the second arm 42 of the rocker arm 40 to the non-connected state. However, the first arm 41 may include a contact portion that contacts with the cam 21A, 23A after the second arm 42 starts pivoting as the roller 43 is pushed by the cam 21A, 23A. In such a case, it is possible to change the timing with which the valve 20, 22 is opened and closed by switching the first arm 41 and the second arm 42 to the non-connected state. Thus, it is possible to change the period in which the valve 20, 22 is open. For example, by extending the period in which the valve 20, 22 is open when the speed of the internal combustion engine 10 is high, it is possible to improve the performance at a high engine speed.

In the preferred embodiments described above, the internal combustion engine 10 is preferably a multi-cylinder engine. However, the internal combustion engine 10 may be a single-cylinder engine with which it is possible to change the timing with which the valve 20, 22 is opened/closed.

In the preferred embodiments described above, the internal combustion engine 10 includes a variable valve mechanism. That is, the rocker arm 40 includes the first arm 41, and the second arm 42 pivotally supported on the first arm 41. The internal combustion engine 10 includes the connection switch pin 66 as a connector that removably connects the first arm 41 and the second arm 42. However, the internal combustion engine 10 may not include a variable valve mechanism. The connector may be omitted. The second arm 42 may be integral with the first arm 41, and the rocker arm 40 may be a single-piece member. The internal combustion engine 10 may be unable to bring the valve 20, 22 to the inoperative state, and may be unable to change the timing with which the valve 20, 22 is opened/closed.

The terms and expressions used herein are used for explanation purposes and should not be construed as being restrictive. It should be appreciated that the terms and expressions used herein do not eliminate any equivalents of features illustrated and mentioned herein, but include various modifications falling within the claimed scope of the present invention. The present invention may be embodied in many different forms. The present disclosure is to be considered as providing examples of the principles of the present invention. These examples are described herein with the understanding that such examples are not intended to limit the present invention to preferred embodiments described herein and/or illustrated herein. Hence, the present invention is not limited to the preferred embodiments described herein. The present invention includes any and all preferred embodiments including equivalent elements, modifications, omissions, combinations, adaptations and/or alterations as would be appreciated by those skilled in the art on the basis of the present disclosure. The limitations in the claims are to be interpreted broadly based on the language included in the claims and not limited to examples described in the present specification or during the prosecution of the application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. An internal combustion engine comprising:

a cylinder head including a hole;

a port in the cylinder head;

a valve in the cylinder head configured to open/close the port;

a cam shaft rotatably supported on the cylinder head;

a cam provided on the cam shaft;

a columnar support at least partially located in the hole;

a rocker arm including a supported portion pivotally supported on the columnar support, a pressed portion pressed by the cam, and an abutting portion that abuts on the valve;

a retainer that includes a first contact portion that contacts with the columnar support, a second contact portion that contacts with the cylinder head, and an elastic portion interposed between the first contact portion and the second contact portion; and a groove provided on an inner surface of the hole and that engages with the retainer; wherein the retainer secures the columnar support inside the hole;

the retainer further includes a plunger including a spring located inside the columnar support, and a presser at least partially located outside the columnar support and that is connected to the spring; and in a cross section that passes through the groove and a center line of the hole, the groove includes a sloped surface that is inclined relative to the center line and extends upward toward the rocker arm.

2. The internal combustion engine according to claim 1, wherein the groove is cone-shaped or cylinder-shaped and has an axis that is inclined relative to the center line of the hole.

3. The internal combustion engine according to claim 1, wherein the hole and the columnar support each have a cylindrical shape; and the groove is a circumferential groove.

4. The internal combustion engine according to claim 1, wherein the rocker arm further includes a first arm that includes the supported portion and the abutting portion, and a second arm that includes the pressed portion and is pivotally connected to the first arm;

the internal combustion engine further includes a connector that removably connects the first arm to the second arm; and the columnar support is not able to expand/contract in an axial direction of the columnar support.

5. A vehicle comprising the internal combustion engine according to claim 1.

6. An internal combustion engine comprising:

a cylinder head including a hole;

a port in the cylinder head;

a valve in the cylinder head configured to open/close the port;

a cam shaft rotatably supported on the cylinder head;

a cam provided on the cam shaft;

a columnar support at least partially located in the hole;

a rocker arm including a supported portion pivotally supported on the columnar support, a pressed portion pressed by the cam, and an abutting portion that abuts on the valve; and a retainer that includes a first contact portion that contacts with the columnar support, a second contact portion that contacts with the cylinder head, and an elastic portion interposed between the first contact portion and the second contact portion;

wherein the retainer secures the columnar support inside the hole; and the retainer further includes a ring-shaped coil spring that is wound around the columnar support.

7. An internal combustion engine comprising:

a cylinder head including a hole;

a port in the cylinder head;

a valve in the cylinder head configured to open/close the port;

a cam shaft rotatably supported on the cylinder head;

a cam provided on the cam shaft;

a columnar support at least partially located in the hole;

a rocker arm including a supported portion pivotally supported on the columnar support, a pressed portion pressed by the cam, and an abutting portion that abuts on the valve; and a retainer that includes a first contact portion that contacts with the columnar support, a second contact portion that contacts with the cylinder head, and an elastic portion interposed between the first contact portion and the second contact portion;

wherein the retainer secures the columnar support inside the hole; and the retainer further includes a plunger including a spring located inside the cylinder head, and a presser at least partially located inside the hole and that is connected to the spring.

8. An internal combustion engine comprising:

a cylinder head including a hole;

a port in the cylinder head;

a valve in the cylinder head configured to open/close the port;

a cam shaft rotatably supported on the cylinder head;

a cam provided on the cam shaft;

a columnar support at least partially located in the hole;

a rocker arm including a supported portion pivotally supported on the columnar support, a pressed portion pressed by the cam, and an abutting portion that abuts on the valve; and a retainer that includes a first contact portion that contacts with the columnar support, a second contact portion that contacts with the cylinder head, and an elastic portion interposed between the first contact portion and the second contact portion;

wherein the retainer secures the columnar support inside the hole; and the retainer further includes a ring-shaped coil spring that is fitted to an inner surface of the hole.

9. An internal combustion engine comprising:

a cylinder head including a hole;

a port in the cylinder head;

a valve in the cylinder head configured to open/close the port;

a cam shaft rotatably supported on the cylinder head;

a cam provided on the cam shaft;

a columnar support at least partially located in the hole;

a rocker arm including a supported portion pivotally supported on the columnar support, a pressed portion pressed by the cam, and an abutting portion that abuts on the valve; and a retainer that includes a first contact portion that contacts with the columnar support, a second contact portion that contacts with the cylinder head, and an elastic portion interposed between the first contact portion and the second contact portion;

wherein the retainer secures the columnar support inside the hole; and the retainer further includes a leaf spring that is secured to an edge of the hole.

* * * * *